US005102759A

United States Patent [19]

Fuse et al.

[11] Patent Number: 5,102,759

[45] Date of Patent: Apr. 7, 1992

[54] ELECTROPHOTOGRAPHIC PHOTORECEPTOR

[75] Inventors: Masahiro Fuse, Machida; Shigenori Otsuka, Omiya, both of Japan

[73] Assignee: Mitsubishi Kasei Corporation, Tokyo, Japan

[21] Appl. No.: 619,259

[22] Filed: Nov. 28, 1990

[30] Foreign Application Priority Data

Dec. 1, 1989 [JP] Japan ..... 1-312376
May 22, 1990 [JP] Japan ..... 2-132378

[51] Int. Cl.[5] ..... G03G 5/14

[52] U.S. Cl. ..... 430/59; 430/58; 430/60

[58] Field of Search ..... 430/58, 59, 60

[56] References Cited

U.S. PATENT DOCUMENTS 4,943,501 7/1990 Kinoshita et al. ..... 430/58

FOREIGN PATENT DOCUMENTS 0340930 8/1989 European Pat. Off. .
63-178242 7/1988 Japan .
63-180954 7/1988 Japan .

*Primary Examiner*—Marion E. McCamish
*Assistant Examiner*—S. Rosasco
*Attorney, Agent, or Firm*—David G. Conlin; Ernest V. Linek

[57] ABSTRACT

An electrophotographic photoreceptor comprising an electroconductive substrate and a photosensitive layer thereon containing a carrier generation material, a carrier transport material and an amine compound represented by the following formula (I):

(I)

wherein A represents one selected from the group consisting of (i) $-CH_2X$, (ii) $-CH_2CH_2X$, wherein X represents an aromatic carbocyclic ring residue, an aromatic heterocyclic ring residue, a cycloalkyl group or a heterocycloalkyl group which may have a substituent, (iii) a cycloalkyl group or a heterocycloalkyl group which may have a substituent, and (iv) an aromatic carbocyclic ring residue or an aromatic heterocyclic ring residue which may have a substituent; B represents one selected from the group consisting of (i), (ii) and (iii) as defined in A; and R represents a hydrogen, alkyl group which may have a substituent or aralkyl group which may have a substituent is disclosed. The electrophotographic photoreceptor according to the present invention has an excellent electrophotographic characteristics, high resistance against ozone and nitrogen oxides, stable characteristics and image quality even after repeated use and extremely high durability.

12 Claims, No Drawings

ELECTROPHOTOGRAPHIC PHOTORECEPTOR

BACKGROUND OF THE INVENTION

1. Field of the Invention

This invention concerns an electrophotographic photoreceptor. More Specifically, it relates to an electrophotographic photoreceptor excellent in ozone resistance and also excellent in stability and durability.

2. Description of the Prior Art

As electrophotographic photoreceptors, inorganic photoconductive substances such as selenium, selenium-tellurium alloy, arsenic selenide or cadmium sulfide have been used generally.

In recent years, studies on the use of organic photoconductive substances for photosensitive layers have become active and laminate photoreceptors comprising a carrier generation layer and a carrier transport layer in which the function of absorbing light and generating charge carriers and the function of transporting generated charge carriers are separated have been deviced, which constitute a main stream of the studies, since they are suitable to mass production and have a possibility of providing materials of high safety. An organic compound having a high carrier generating effect and another organic compound having a carrier transporting effect are combined in the laminate type photoreceptor, to obtain a photoreceptor of high sensitivity, which is put to practical use. Since the carrier transport layer is laminated on the carrier generation layer and since the carrier transport layer usually has only positive hole moving function, the laminate electrophotographic photoreceptor has a sensitivity only when it is charged negatively and it is used under the negatively charged state.

On the other hand, in the electrophotography, the photoreceptor is usually charged by corona discharge. However, it is difficult in the negative corona discharge to attain uniform discharge in the direction of the wire and, thus, it is difficult to obtain uniform charge as compared with positive corona discharge. In addition, selenium-based photoreceptors conventionally used in the prior art work under positive charging, accordingly, an organic photoreceptor that can be used in the positively charged state is also studied with an intention of utilizing the prior art in view of the developer and other peripheral processes used in the system. For instance, there have been proposed and studied for a so-called reverse two-layer photoreceptor in which a carrier transport layer and a carrier generation layer are are laminated in this order on a support, and a dispersion type photoreceptor in which particles of the carrier generating substance are dispersed in the carrier transporting medium. In the reverse two-layer and dispersion type photoreceptor, incident light is absorbed on the surface and the region of generating carriers situates near the surface and it is used under positive charging.

Thus, photoreceptors of several constitutions have been proposed and studied and photoreceptors having excellent charging characteristics and sensitivity have been developed. Electrophotographic photoreceptors are used repeatedly in the system and required to have always constant and stable electrophotographic characteristics throughout the use, but no sufficient stability and durability have yet been obtained at present with any of the constitutions described above. That is, they result in lowering of the potential, increase of the residual potential, change of the sensitivity and the like along with the repeated use to cause reduction of the copy quality and become no more usable. Although the cause for such degradation has not yet been quite clear, there may be considered several factors. Among them, it has been known that oxidative gases such as ozone and nitrogen oxides released from a corona charger give a remarkable damage on the photosensitive layer. The oxidative gases result in chemical changes for the materials in the photosensitive layer to bring about various changes of characteristics. For instance, lowering of the resolution power due to the lowering of the charged potential, increase of the residual potential and the lowering of the surface resistance are recognized, to result in remarkable lowering of the image quality and shorten the life of the photoreceptor.

Against them, it has been considered to effectively exhaust and replace gases near the corona charger thereby avoiding the effect on the photoreceptor, or there has been proposed to prevent degradation by adding an anti-oxidant or a stabilizer to the photosensitive layer. For instance, there have been proposed the addition of an anti-oxidant having a triazine ring and a hindered phenol skelton in the molecule in Japanese Patent Laid-Open (KOKAI) No. 62-105151 (1987), addition of hindered amines in Japanese Patent Laid-Open (KOKAI) Nos. 63-73256 (1988) and 63-18355 (1988), addition of a trialkylamine in Japanese Patent Laid-Open (KOKAI) No. 63-4238 (1988), addition of an aromatic amine in Japanese Patent Laid-Open (KOKAI) No. 63-216055 (1988) and addition of a specific aniline derivative in Japanese Patent Laid-Open (KOKAI) No. 63-96662 (1988).

However, even with such prior art, only insufficient effects can be obtained for practical use at present, for example, no sufficient effect for the ozone resistance can yet be obtained, or electrophotographic characteristics such as the sensitivity or the residual potential are worsened due to the addition of the anti-oxidants as described above.

The present inventors have made an extensive study for the improvement of the ozone resistance of an organic photoreceptor having a carrier generation substance and a carrier transport substance and, as a result, have accomplished the present invention based on the finding that a photoreceptor of excellent electric characteristics with remarkably improved ozone resistance can be obtained by adding a specific amine compound to a photosensitive layer.

SUMMARY OF THE INVENTION

The present invention provides an electrophotographic photoreceptor comprising an electroconductive substrate and a photosensitive layer containing a charge generating material, a charge transporting material and an amine compound represented by the following formula (I):

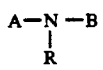

(I)

wherein A represents one selected from the group consisting of (i) $-CH_2X$, (ii) $-CH_2CH_2X$, in which X represents an aromatic carbocyclic ring residue, an aromatic heterocyclic ring residue, a cycloalkyl group or a heterocycloalkyl group, which may have a substituent, (iii) a cycloalkyl group or a heterocycloalkyl group which may have a substituent, and (iv) an aromatic carbocyclic ring residue or an aromatic heterocyclic ring residue which may have a substituent, B represents one selected from the group consisting of (i), (ii) and (iii) in A and R represents a hydrogen, alkyl group or aralkyl group in which the alkyl group and the aralkyl group may have a substituent.

DETAILED DESCRIPTION OF THE INVENTION

The present invention will now be described more in details.

The photosensitive layer in the present invention at least containing a carrier generation material and a carrier transport material. As more precise constitutions, there can be mentioned the following constitutions as examples of basic forms:

a laminate photoreceptor in which a carrier generation layer comprising a carrier generation material as the main ingredient, and a carrier transport layer comprising the carrier transport material and a binder resin as the main ingredient are laminated in this order on an electroconductive substrate, a reversed two-layer photoreceptor in which a carrier transport layer comprising a carrier transport material and a binder resin as the main ingredient and a carrier generation layer comprising a carrier generation material as the main ingredient are laminated in this order on an electroconductive substrate, and a dispersion type photoreceptor in which a carrier generation material is dispersed into a layer containing a carrier transport material and a binder resin disposed on an electroconductive substrate.

The above-mentioned photosensitive layer is formed on an electroconductive substrate by means of a known method such as roll coating, bar coating, dip coating or spray coating. If necessary, a barrier layer such as made of polyamide, polyurethane, aluminum oxide or the like may be disposed between the electroconductive substrate and the photosensitive layer. Further, a protection layer comprising a polyamide, thermosetting silicone resin or crosslinked acrylic resin may be disposed as required on the surface of the photosensitive layer.

As the electroconductive substrate, various known materials may be used. For example, there can be mentioned a metal drum such as made of aluminum, copper, nickel or stainless steel; and synthetic resin film, synthetic resin drum, glass drum or paper subjected to electroconductive treatment, for example, by laminating a metal foil, vapor depositing or sputtering metal or electroconductive oxide, or coating an electroconductive substance such as metal powder, carbon black, copper iodide or tin oxide, if necessary, together with a binder resin.

As the carrier generation material usable in the present invention, various organic and inorganic carrier generation material can be used. For instance, as the inorganic carrier generation material, various kinds of alloy materials containing selenium as the main ingredient such as amorphous selenium, selenium-tellurium alloy, trigonal system selenium, arsenic triselenide, etc.; semiconductor material of (II) group element-(VI) group element compound such as cadmium sulfide and cadmium selenide; amorphous silicon, hydrogenated silicon are used in the state of fine particles. In addition, as the organic carrier generation substance, there can be used phthalocyanine pigment, perylene pigment, polycyclic quinones, quinacridone pigment, indigo pigment, squalenium salt and azo pigment.

Among them, phthalocyanine pigment and azo pigment can be used as more preferable material. As the phthalocyanine pigment expressed by the following general formula can be exemplified.

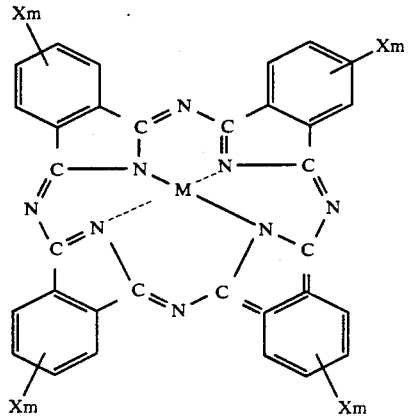

Phthalocyanine containing metal atom in which M is Cu, Fe, Mg, Si, Ge, Sn, Pb, Incl, GaCl, AlCl, TiO and non metal containing phthalocyanine having two hydrogen atoms in place of M can be mentioned. X represents hydrogen atom, lower alkyl group, lower alkoxy group, nitro group, cyano group, halogen atom and m represents an integer from 0 to 4.

Various kinds of the azo pigments can be mentioned and monoazo pigment, bisazo pigment, trisazo pigment and other polyazo pigments containing at least one coupler component represented by the following formula can be mentioned as more preferred materials.

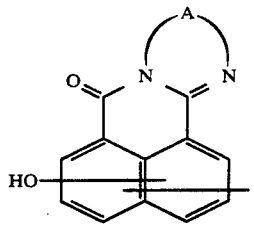

in which A represents a divalent group of an aromatic hydrocarbon or a divalent group of a heterocyclic ring containing a nitrogen atom in the ring.

In the case of the laminate structur, the carrier generation material is used as the main ingredient constituting the carrier generation layer which may be used as a homogenous layer formed, for example, by a method of vapor deposition or sputtering, or it may be used in the form of fine particles dispersed in the binder resin. As the binder resin in this case, there can be used various kinds of binder resins, for example, polyvinyl acetate, polyacrylic acid ester, methacrylate resin, polyester resin, polycarbonate resin, polyvinyl acetal resin such as polyvinyl butyral and polyvinyl formal, phenoxy resin, cellulose ester, cellulose ether, urethane resin and epoxy resin. The mixing ratio of the carrier generation material and the binder resin is preferably within a range usually from 100:10 to 5:100 by weight ratio, and the carrier transport material may be incorporated in this layer. The carrier generation layer is usually used preferably with a thickness of from 0.1 to 10 μm. Further, in the case of the dispersion type photosensitive layer as described above, the carrier generation material is dispersed in the form fine particles into a matrix having the carrier transport material and the binder resin.

As the carrier transport material used in the present invention, there can be mentioned various known materials used for the electrophotographic photoreceptors. There can be mentioned electron donating substances, for example, a compound having a heterocyclic ring such as carbazole, indole, imidazole, thiazole, oxadiazole, pirazole and pirazoline; an aniline derivative such as phenylamine, diphenylamine or triphenylamine; a hydrazone derivative, a stilbene derivative; or a polymer having groups derived from the compounds described above in the main chain or the side chain.

As a particularly preferred substance, there can be mentioned a hydrazone derivative, aniline derivative and stilbene derivative.

Various known resins can be used as the binder resin to be used together with the carrier transport material. Thermoplastic resins and thermosetting resins such as polycarbonate resin, polyester resin, polyarylate, acrylic resin, methacrylate resin, styrene resin and silicone resin can be used. Among all, the polycarbonate resin, polyacrylate resin and polyester resin are preferred because their abrasion and scratch resistance. As the bisphenol component for the polycarbonate resin, various known components such as bisphenol-A, bisphenol-C and bisphenol-Z can be used.

The carrier transport material and the binder resin are blended at a blending ratio within a range, for example, from 20 to 200 parts by weight, preferably, 40 to 150 parts by weight based on 100 parts by weight of the binder resin. In the case of the laminate photoreceptor, the carrier transport layer is formed by using the above-mentioned components as the main component and the carrier transport layer is usually used at a thickness of from 5 to 50 μm, preferably, from 10 to 40 μm.

In the case of the dispersion type photoreceptor, the carrier generation material is dispersed in the form of fine particles in a matrix comprising the carrier transport material and the binder resin as the main components at the blending ratio as described above and it is necessary that the particle size of the carrier generation material is sufficiently small, preferably, less than 1 μm and, more preferably, less than 0.5 μm. If the amount of the carrier generation material dispersed in the photosensitive layer is too small, no sufficient sensitivity can be obtained. On the other hand, if it is excessive, troubles such as lowering of the charging characteristics and the lowering of the sensitivity may occur and, for example, it is used preferably within a range from 0.5 to 50% by weight and, more preferably, within a range from 1 to 20% by weight. The photosensitive layer is preferred to have a thickness from 5 to 50 μm and, more preferably, 10 to 40 μm.

The amine compound used in the present invention is a compound represented by the following formula (I):

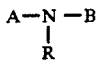

(I)

In the formula (I) A represents one selected from the group consisting of (i) $-CH_2X$, (ii) $-CH_2CH_2X$, in which X represents an aromatic carbocyclic ring residue such as a phenyl group, naphthyl group and anthryl group, an aromatic heterocyclic ring residue such as a thiophenyl group, a cycloalkyl group such as a cyclohexyl group and cyclopentyl group or a heterocycloalkyl group such as a tetrahydropyranyl group, a phenyl group being particularly preferred, which may have a substituent selected from an alkyl group, aryl group, aralkyl group, alkoxy group, aryloxy group, hydroxyl group, cyano group and halogen atom;

(iii) a cycloalkyl group such as a cyclohexyl group cyclopentyl group or a heterocycloalkyl group such as a tetrahydropyranyl group, which may be substituted with an alkyl group or alkoxy group; and (iv) an aromatic carboxyclic ring residue such as a phenyl group, naphthyl group and anthryl group, or an aromatic heterocyclic ring residue such as thiophenyl group, a phenyl group being particularly preferred, which may be substituted with an alkyl group, aryl group or aralkyl group.

In the formula (I), B represents a group selected from the group consisting of (i), (ii) and (iii) as defined in A.

Further, R represents a hydrogen atom; an alkyl group such as propyl, tert-butyl, hexyl or decyl; or an aralkyl group such as benzyl or naphthylmethyl in which the alkyl group and the aralkyl group may have a substituent such as an alkyl group, aryl group, alkoxy group, aryloxy group, hydroxy group, cyano group, cycloalkyl group, heterocyclic ring residue or halogen atom. R is preferred to have at least three carbon atoms and to be a statically bulky group such as a tert-butyl group, benzyl group and decyl group. Among these, a benzyl group is more preferred.

Specific examples of the compounds represented by the formula (I) are shown in the following Table 1.

The amine compound represented by the formula (I) can be easily produced in accordance with a conventionally known method.

TABLE 1
Examples of Amine Compound
| Compound Number | Structure |
|---|---|
| (1) | 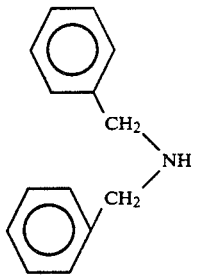 |
| (2) | 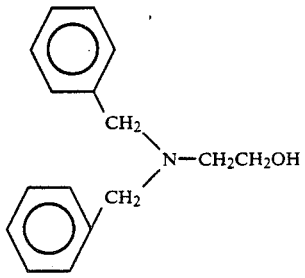 |
| (3) | 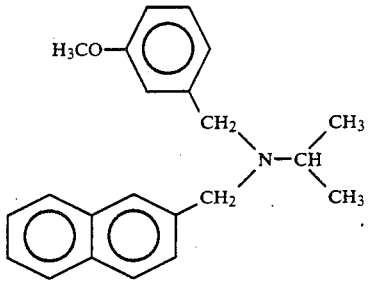 |
| (4) | 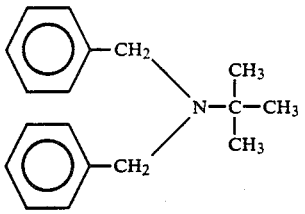 |
| (5) | 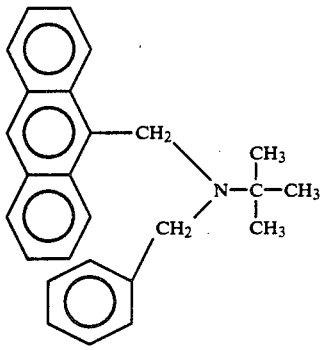 |

TABLE 1-continued
Examples of Amine Compound
| Compound Number | Structure |
|---|---|
| (6) | 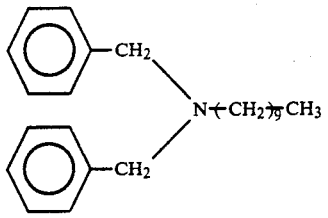 |
| (7) | 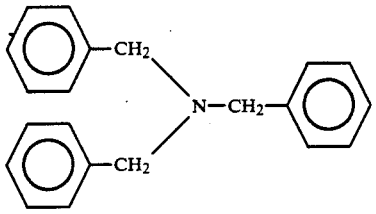 |
| (8) | 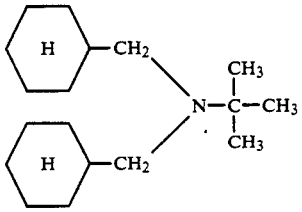 |
| (9) | 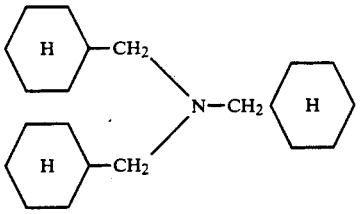 |
| (10) | 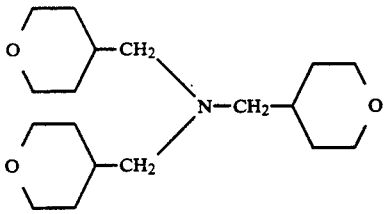 |
| (11) | 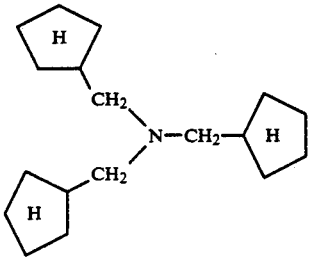 |

TABLE 1-continued
| Compound Number | Examples of Amine Compound Structure |
|---|---|
| (12) | 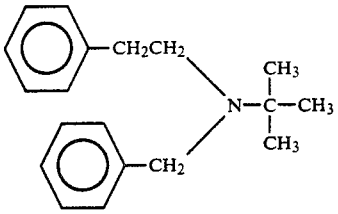 |
| (13) | 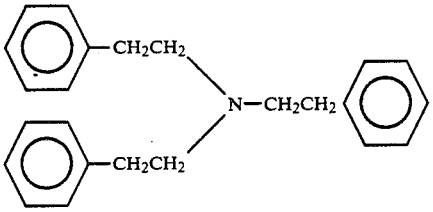 |
| (14) | 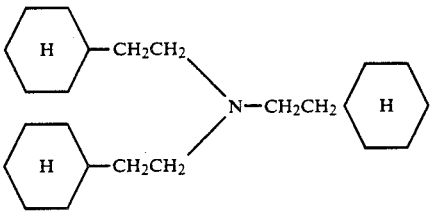 |
| (15) | 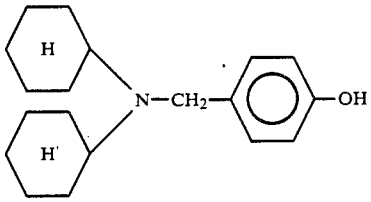 |
| (16) | 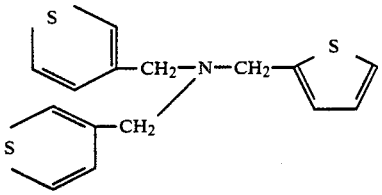 |
| (17) | 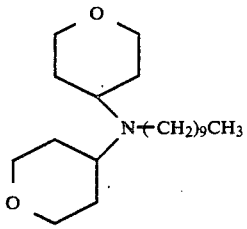 |
| (18) | 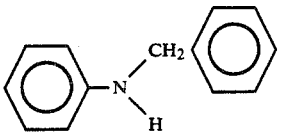 |

TABLE 1-continued
| Compound Number | Examples of Amine Compound Structure |
|---|---|
| (19) | 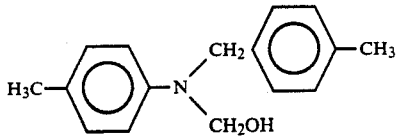 |
| (20) | 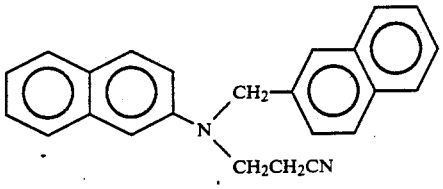 |
| (21) | 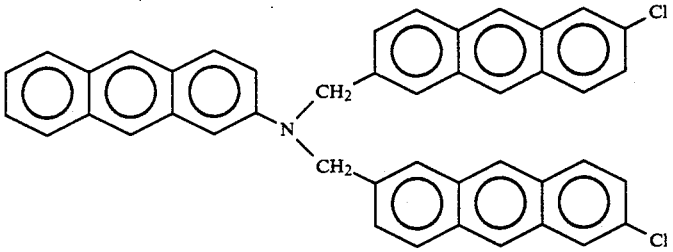 |
| (22) | 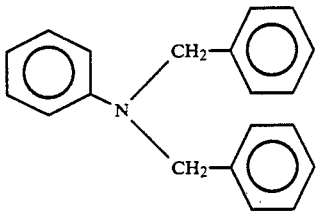 |
| (23) | 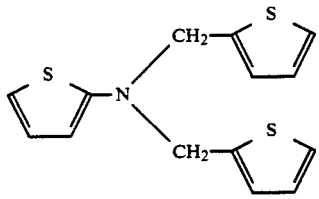 |
| (24) | 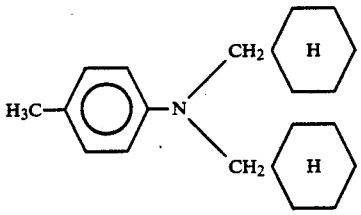 |
| (25) | 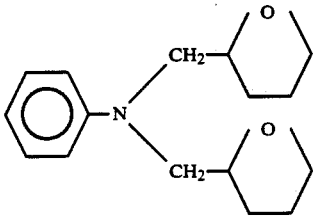 |

TABLE 1-continued

| Compound Number | Examples of Amine Compound Structure |
|---|---|
| (26) | 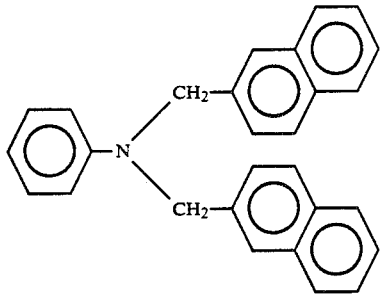 |
| (27) | 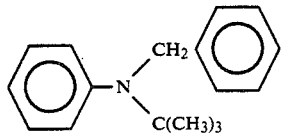 |
| (28) | 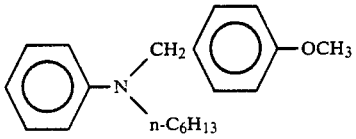 |

The amine compound is added to all of or a part of the layers in the photosensitive layer such as a carrier generation layer, carrier transport layer, etc. Since degradation proceeds from the surface, it is preferably added at least to the surface layer. If the protection layer or the blocking layer is disposed, the amine compound may be added also to these layers. The amine compound is added into a layer in an amount usually from 0.1 to 20% by weight, more preferably, from 1 to 16% by weight.

Furthermore, the photosensitive layer according to the present invention may further contain a known prasticizer for improving the film-forming property, flexibility, mechanical strength and the like, an additive for suppressing the accumulation of residual potential, a dispersion aid for improving the dispersion stability, a levelling agent for improving the coatability, for example, silicone oil, as well as other additives.

The electrophotographic photoreceptor according to the present invention has an advantage as a photoreceptor having excellent electrophotographic characteristics, less undergoing the effect of ozone and nitrogen oxides generated from the system, having stable characteristics and image quality even after repeated use and having extremely high durability.

The photoreceptor according to the present invention can be widely applied in electrophotography, for example, in electrophotographic copying machines, as well as various kinds of printers.

The present invention will now be described more in details with reference to examples but it should be noted that the present invention is not restricted by the following examples unless it does not exceed the scope of the present invention.

"Part" or "parts" in the examples represents part or parts by weight.

EXAMPLE 1 AND COMPARATIVE EXAMPLE 1

To 5 parts of bisazo compound having the following structure, were added 180 parts of cyclohexanone and preliminary dispersion was conducted by a sand grind mill.

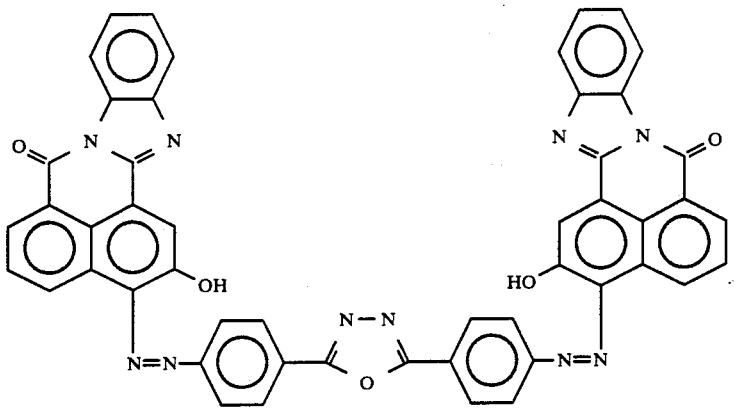

Separately, into 380 parts of cyclohexanone, were dissolved 50 parts of a polycarbonate resin having the following constitutional repeating unit (viscosity average molecular weight: about 22000),

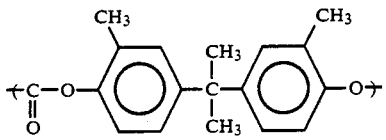

50 parts of a hydrazone compound having the following structure,

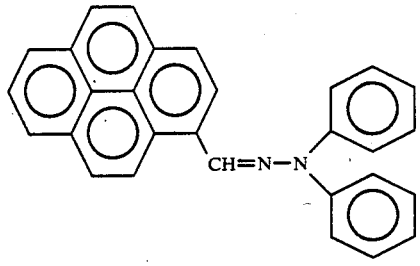

and 1.5 parts of the amine compound No. 2 listed in Table 1. The resultant mixture was added with the preliminary dispersion prepared above and dispersed by a homogenizer to obtain a coating solution.

The coating solution was coated on a polyester film on which aluminum was vapor-deposited so that the thickness of the coating is 20 μm after drying to obtain a sample 1A.

When the electrophotographic characteristics of the sample 1A were measured, the initial charged voltage was +721 V, the exposure $E_{\frac{1}{2}}$ required for reducing the surface potential from 500 V to 250 V was 3.2 lux.sec and the residual potential 10 seconds after the exposure was +8 V.

Then, for examining the ozone resistance, the sample 1A was left under a corona discharging atmosphere. A corona discharger was placed in a box and a voltage of −7 kV was applied. Air in the box was circulated by a fan equipped to the box to keep a uniform atmosphere. The ozone concentration was 25 ppm. The sample 1A was exposed to this ozone atmosphere for 5 hours, then stored under ordinary atmosphere for 19 hours, and finally exposed to the ozone atmosphere again for 5 hours. The characteristics of the thus treated sample 1A were examined to obtain the results that the charged voltage which was +721 V at the initial stage was +758 V with a little change.

Then, samples 1B to 1F were prepared in the same manner as in the preparation of the sample 1A, except that the respective amine compounds of Nos. 4, 6, 7, 9 and 13 were used in place of the amine compound No. 2.

A comparative sample 1G was prepared in the same preparation method as described above except for using no amine compound.

Then, respective comparative samples 1H to 1K were prepared in the same manner as described above except that each of the following amine compounds (i) to (iv) which were known to be added to an organic electrophotographic photoreceptors were used in the respective samples.

$N(n\text{-}C_{10}H_{21})_3$ (i)

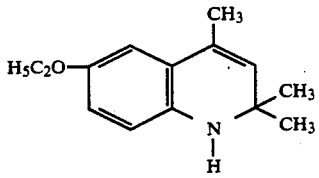

(ii)

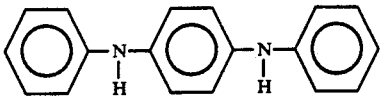

(iii)

-continued

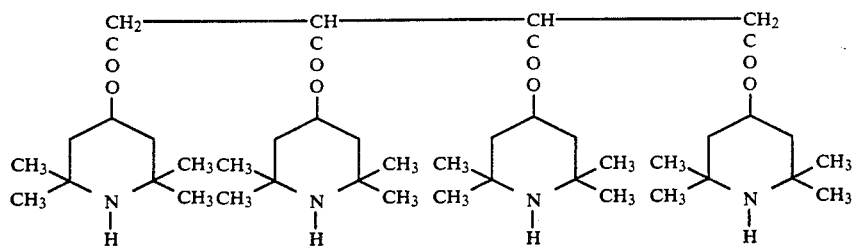

(iv)

Then, a comparative sample 1L was prepared in the same manner as described above except that an equivalent amount of di-t-butylhydroxytoluene (hereinafter referred to as "BHT") which was a known anti-oxidant to be added to a photosensitive layer was used in place of the amine compound.

Electrophotographic characteristics and the ozone resistance were evaluated also for these samples in the same manner as in the sample 1A. The results are shown in Table 2.

As can be seen from the results, the photosensitive layer of the samples 1A to 1F was excellent in the sensitivity and also in the ozone resistance. However, the charged voltage was remarkably lowered by the exposure to ozone when the amine compound according to the present invention is not used (comparative sample 1G). Further, the sensitivity in the initial stage was remarkably lowered although the change of the charged voltage due to the ozone exposure could be avoided when the amine compound known to be used in an organic electrophotographic receptor (comparative samples 1H to 1K). It could be also seen from the results on the comparative sample 1L that the effect was insufficient when the known phenolic anti-oxidant was used.

Then, for examining the ozone resistance, the sample 2A was left under a corona discharging atmosphere. A corona discharger was placed in a box and a voltage of −7 kV was applied. Air in the box was circulated by a fan equipped to the box to keep a uniform atmosphere. The ozone concentration was 10 ppm. The sample 2A was exposed to this ozone atmosphere for 10 hours, then the characteristics of the thus treated sample 2A were examined. The charged voltage which was +573 V at the initial stage was +562 V with a slight decrease.

Then, sample 2B was prepared in the same manner as in the preparation of the sample 2A, except that the amine compound No. 22 in Table 1 was used in place of the amine compound No. 18. Sample 2B was also excellent in the ozone resistance and sensitivity. The results are shown in Table 3.

A comparative sample 2C was prepared in the same preparation method as described above except for using no amine compound.

Then, respective comparative samples 2D to 2G were prepared in the same manner as described above except that each of the following amine compound (v) and the amine compounds (ii) to (iv) described above, which were known to be added to an organic electrophotographic photoreceptors, were used in the respective samples.

TABLE 2

| Sample | Compound added | Initial characteristics: Charged voltage (V) | Initial characteristics: Sensitivity $E_{\frac{1}{2}}$ (lux · sec) | Characteristics after ozone exposure: Charged voltage (V) | Characteristics after ozone exposure: Potential retention ratio* (%) |
|---|---|---|---|---|---|
| Sample 1A | Compound No. 2 | 721 | 3.2 | 758 | 105 |
| 1B | Compound No. 4 | 591 | 1.2 | 590 | 100 |
| 1C | Compound No. 6 | 662 | 1.7 | 669 | 101 |
| 1D | Compound No. 7 | 663 | 1.0 | 623 | 94 |
| 1E | Compound No. 9 | 709 | 2.8 | 666 | 94 |
| 1F | Compound No. 13 | 711 | 3.5 | 747 | 105 |
| Comparative Sample 1G | None | 580 | 0.9 | 157 | 27 |
| 1H | Known amine compound (i) | 583 | 12.1 | 626 | 107 |
| 1I | Known amine compound (ii) | 621 | 15.0 | 581 | 94 |
| 1J | Known amine compound (iii) | 793 | ≧15 | 765 | 96 |
| 1K | Known amine compound (iv) | 620 | 8.5 | 608 | 98 |
| 1L | BHT | 608 | 0.9 | 316 | 52 |

$$\text{*Potential retention ratio (\%)} = \frac{\text{Charged voltage after } O_3 \text{ exposure}}{\text{Initial charged voltage}} \times 100$$

EXAMPLE 2 AND COMPARATIVE EXAMPLE 2

Sample 2A was prepared in the same manner as in Example 1 except for using compound No. 18 listed in Table 1 as the amine compound.

When the electrophotographic characteristics of the sample 2A were measured, the initial charged voltage was +573 V, the exposure E1/5 required for reducing the surface potential from 500 V to 100 V was 2.42 lux.sec and the residual potential 10 seconds after the exposure was +3 V.

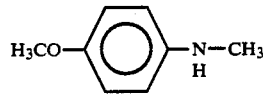

(v)

Then, a comparative sample 2H was prepared in the same manner as described above except that BHT was used in place of the amine compound.

Electrophotographic characteristics and the ozone resistance were evaluated also for these samples in the same manner as in the sample 2A. The results are shown in Table 3.

As can be seen from the results, the photosensitive layer of the samples 2A and 2B was excellent in the sensitivity and also in the ozone resistance. However, the charged voltage was remarkably lowered by the exposure to ozone when the amine compound according to the present invention is not used (comparative sample 2C). Further, the sensitivity in the initial stage was remarkably lowered although the change of the charged voltage due to the ozone exposure could be avoided when the amine compound known to be used in an organic electrophotographic receptor (comparative samples 2D to 2G). It could be also seen from the results on the comparative sample 2H that the effect was insufficient when the known phenolic anti-oxidant was used.

TABLE 3.

| Sample | Compound added | Initial characteristics: Charged voltage (V) | Initial characteristics: Sensitivity E1/5 (lux · sec) | Characteristics after ozone exposure: Charged voltage (V) | Characteristics after ozone exposure: Potential retention ratio* (%) |
|---|---|---|---|---|---|
| Sample 2A | Compound No. 18 | 573 | 2.4 | 562 | 98 |
| 2B | Compound No. 22 | 709 | 2.4 | 674 | 95 |
| Comparative Sample 2C | None | 580 | 2.0 | 232 | 40 |
| 2D | Known amine compound (v) | 702 | 37.6 | 709 | 101 |
| 2E | Known amine compound (ii) | 621 | ≧40 | 633 | 102 |
| 2F | Known amine compound (iii) | 793 | ≧40 | 785 | 99 |
| 2G | Known amine compound (iv) | 620 | 30.8 | 608 | 98 |
| 2H | BHT | 608 | 2.1 | 377 | 62 |

$$\text{*Potential retention ratio (\%)} = \frac{\text{Charged voltage after } O_3 \text{ exposure}}{\text{Initial charged voltage}} \times 100$$

EXAMPLE 3 AND COMPARATIVE EXAMPLE 3

A sample 3A was prepared in the same manner as the preparation method for the sample 1A in Example 1 except that a triphenylamine derivative of the following structure:

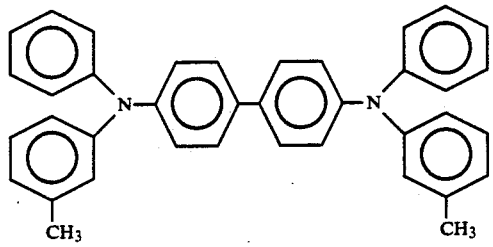

was used in place of the hydrazone compound and the amine compound No. 7 in Table 1 was used.

Further, a comparative sample 3B was prepared in the same manner as in preparation of 3A except for using no amine compound.

The results of the evaluations for electrophotographic characteristics and ozone resistance after five-hour exposure under an atmosphere of 12 ppm ozone concentration on each of the photoreceptors obtained are shown in Table 4.

TABLE 4

| Sample | Compound added | Initial characteristics: Charged voltage (V) | Initial characteristics: Sensitivity E1/5 (lux · sec) | Characteristics after ozone exposure: Charged voltage (V) | Characteristics after ozone exposure: Potential retention ratio* (%) |
|---|---|---|---|---|---|
| Sample 3A | Compound No. 7 | 510 | 1.85 | 428 | 84 |
| Comparative Sample 3B | None | 428 | 2.49 | 41 | 10 |

$$\text{*Potential retention ratio (\%)} = \frac{\text{Charged voltage after } O_3 \text{ exposure}}{\text{Initial charged voltage}} \times 100$$

As seen from the results, a photoreceptor excellent in the ozone resistance and sensitivity can be also obtained by adding the amine compound according to the present invention when a triphenylamine type carrier transport material.

EXAMPLE 4 AND COMPARATIVE EXAMPLE 4

One part of the same biazo compound as used in Example 1 was added to 20 parts of dimethoxyethane and subjected to a dispersing treatment by a sand grinder. The dispersion was added to a solution of 0.5 part polyvinyl acetal resin (DENKA BUTYRAL #6000C, trade name, produced by Denki Kagaku Co.) dissolved in 10 parts of dimethoxyethane. The thus obtained dispersion was coated on a polyester film of 75 μm thickness which was vapor-deposited with aluminum in a coating amount of 0.4 g/m² after drying, thereby forming a carrier generation layer.

On the carrier generation layer, was coated a solution of 90 part of N-methylcarbazol diphenylhydrazone, 100 parts of a polycarbonate resin (Novalex 7030A, produced by Mitsubishi Kasei Corporation), 3 parts of the amine compound No. 4 in Table 1, and 4 parts of the following electron accepting compound:

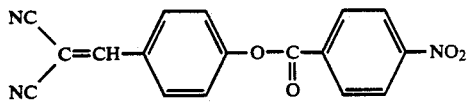

dissolved in 700 parts of dioxane in such an amount that the thickness of the coating is 20 μm after drying, thereby forming a carrier transport layer to obtain a sample 4A.

Then, samples 4B, 4C, 4D and 4E were prepared in the same manner as in the preparation of the sample 4A except that the respective amine compounds Nos. 6, 7, 18 and 22 in Table 1 were used in place of the amine compound No. 4.

For the comparison, a comparative sample 4F was prepared in the same manner as described above except for using no amine compound. Further, comparative samples 4G, 4H and 4I were prepared in the same manner as described above except for adding the known amine compound (iii), (iv) or (v) used in Comparative Example 1 in place of the amine compound according to the present invention.

Then, the electrophotographic characteristics and the ozone resistance of the samples and comparative samples were evaluated in the same manner as in Example 1 except that the exposure E1/5 required for reducing the surface potential from 500 V to 100 V was measured in place of the exposure $E\frac{1}{2}$. The results are shown in Table 5.

It can be seen from the results that the addition of the known amine compound has a drawback of remarkable degradation of characteristics such as the lowering of the sensitivity and high level residual potential. On the other hand, the samples 4A to 4E according to the present invention show excellent characteristics in the sensitivity and residual potential as well as in the ozone resistance.

TABLE 5

| Sample | Compound added | Initial characteristics: Charged voltage (V) | Sensitivity E1/5 (lux · sec) | Residual potential (V) | After ozone exposure: Potential retention ratio* (%) |
|---|---|---|---|---|---|
| Sample 4A | Compound No. 4 | −748 | 2.12 | −15 | 98 |
| 4B | Compound No. 6 | −754 | 2.34 | −20 | 99 |
| 4C | Compound No. 7 | −760 | 1.92 | −12 | 97 |
| 4D | Compound No. 18 | −753 | 1.82 | −9 | 98 |
| 4E | Compound No. 22 | −794 | 1.85 | −11 | 97 |
| Comparative Sample 4F | None | −770 | 1.80 | −7 | 85 |
| 4G | Known amine compound (iii) | −797 | 8.25 | −93 | 98 |
| 4H | Known amine compound (iv) | −784 | 6.00 | −50 | 98 |
| 4I | Known amine compound (v) | −789 | 6.02 | −55 | 98 |

$$\text{*Potential retention ratio (\%)} = \frac{\text{Charged voltage after } O_3 \text{ exposure}}{\text{Initial charged voltage}} \times 100$$

EXAMPLE 5 AND COMPARATIVE EXAMPLE 5

Ten parts of oxytitanium phthalocyanine were added to 200 parts of dimethoxyethane and subjected to a dispersing treatment by a sand grind mill. The dispersion was added to a solution of 5 parts polyvinyl butyral resin (DENKA BUTYRAL #6000C, trade name, produced by Denki Kagaku Co.) dissolved in 100 parts of dimethoxyethane. The thus obtained dispersion was coated on a polyester film of 75 μm thickness which was vapor-deposited with aluminum in a coating amount of 0.4 g/m² after drying, thereby forming a carrier generation layer of 0.3 μm thickness.

On the carrier generation layer, was coated a solution of 100 parts of the following hydrazone compound as a carrier transport material:

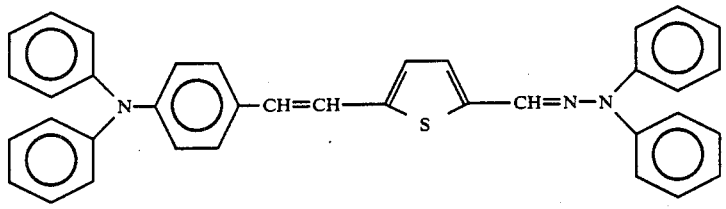

100 parts of a polycarbonate resin (Novalex 7030A, trade name, produced by Mitsubishi Kasei Corporation), 3 parts of the amine compound No. 7 in Table 1, and 1.5 parts of the following electron accepting compound:

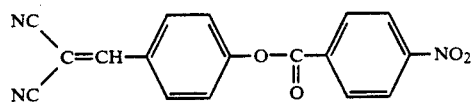

dissolved in 670 parts of dioxane in such an amount that the thickness of the coating is 20 μm after drying, thereby forming a carrier transport layer to obtain a sample 5A.

Then, a sample 5B was prepared in the same manner as in the preparation of the sample 5A except that the amine compounds No. 22 in Table 1 were used in place of the amine compound No. 7.

For the comparison, a comparative sample 5C was prepared in the same manner as described above except for using no amine compound. Further, comparative sample 5D was prepared in the same manner as described above except for adding 3,5-di-t-butylhydroxytoluene (BHT), which was known to be used in an electrophotographic photoreceptor as a deterioration inhibitor due to ozone, in place of the amine compound according to the present invention.

Then, the electrophotographic characteristics and the ozone resistance after ten-hour exposure to an atmosphere of 25 ppm ozone concentration of the samples and comparative samples were evaluated in the same manner as in Example 1. The results are shown in Table 6.

The samples 5A and 5B were excellent in electrophotographic characteristics such as the sensitivity and residual potential as well as in the ozone resistance.

The comparative sample 5C where no amine compound was added showed poor ozone resistance.

The comparative sample 5D where a known hindered phenol type anti-oxidant BHT was added in place of the amine compound according to the present invention showed poor ozone resistance.

Thus, it can be seen that a photoreceptor which is added with the amine compound according to the present invention is remarkably improved in the ozone resistance without deteriorating the electrophotographic characteristics such as the sensitivity and residual potential, as compared to those in which no amine compound is added or a known anti-oxidant is added.

TABLE 6

| Sample | Compound added | Initial characteristics: Charged voltage (V) | Sensitivity $E_{\frac{1}{2}}$ (lux · sec) | Residual potential (V) | After ozone exposure: Potential retention ratio* (%) |
|---|---|---|---|---|---|
| Sample 5A | Compound No. 7 | −711 | 0.11 | −4 | 100 |
| 5B | Compound No. 22 | −682 | 0.11 | −7 | 91 |
| Comparative Sample 5C | None | −526 | 0.11 | −2 | 31 |
| 5D | BHT | −705 | 0.11 | −32 | 58 |

$$\text{*Potential retention ratio (\%)} = \frac{\text{Charged voltage after } O_3 \text{ exposure}}{\text{Initial charged voltage}} \times 100$$

What is claimed is:

1. An electrophotographic photoreceptor comprising an electroconductive substrate and a photosensitive layer thereon containing a carrier generation material, a carrier transport material and an amine compound represented by the following formula (I):

$$\begin{array}{c} A-N-B \\ \quad\;\; | \\ \quad\;\; R \end{array} \qquad (I)$$

wherein A represents one selected from the group consisting of (i) $-CH_2X$, (ii) $-CH_2CH_2X$, wherein X represents an aromatic carbocyclic ring residue, an aromatic heterocyclic ring residue, a cycloalkyl group or a heterocycloalkyl group which may have a substituent, (iii) a cycloalkyl group or a heterocycloalkyl group which may have a substituent, and (iv) an aromatic carbocyclic ring residue or an aromatic heterocyclic ring residue which may have a substituent; B represents one selected from the group consisting of (i), (ii) and (iii) as defined in A; and R represents a hydrogen, alkyl group which may have a substituent or aralkyl group which may have a substituent.

2. The electrophotographic photoreceptor according to claim 1, wherein A represents one selected from the group consisting of (i) and (iv); B represents one selected from the group consisting of (i); R represents an aralkyl group or alkyl group having not less than three carbon atoms, said aralkyl group and alkyl group being capable of having a substituent.

3. The electrophotographic photoreceptor according to claim 2, wherein each of A, B and R independently represents an aralkyl group represented by the following formula:

$-CH_2Y$ wherein Y represents an aromatic carbocyclic ring residue or aromatic heterocyclic residue which may have a substituent.

4. The electrophotographic photoreceptor according to claim 1, wherein A represents one selected from the group consisting of (iv); B represents an aralkyl group represented by the following formula:

$-CH_2Y$ wherein Y represents an aromatic carbocyclic ring residue or aromatic heterocyclic ring residue which may have a substituent; and R represents a hydrogen, alkyl group which may have a substituent or aralkyl group which may have a substituent.

5. The electrophotographic photoreceptor according to claim 1, wherein said carrier generation material is an inorganic fine particle or an organic fine particle.

6. The electrophotographic photoreceptor according to claim 5, wherein said carrier generation material is one selected from the group consisting of azo pigments, phthalocyanine pigments, perylene pigments, polycyclic quinones, quinacridone pigments, indigo pigments and squalilium salts.

7. The electrophotographic photoreceptor according to claim 6, wherein said carrier generation material is an azo pigment or phthalocyanine pigment.

8. The electrophotographic photoreceptor according to claim 1, wherein said carrier transport material is at least one selected from the group consisting of heterocyclic compounds, aniline derivatives, hydrazone derivatives, stilbene derivatives, and polymers having groups derived from said compounds or derivatives in the main polymer chain or the side chain thereof.

9. The electrophotographic photoreceptor according to claim 8, wherein said carrier transport material is a hydrazone derivative or triphenylamine derivative.

10. The electrophotographic photoreceptor according to claim 1, wherein said photosensitive layer comprises a carrier generation layer mainly comprising a carrier generation material and a carrier transport layer mainly comprising a carrier transport material and a binder resin, said carrier transport layer containing an amine compound represented by the formula (I).

11. The electrophotographic photoreceptor according to claim 1, wherein said photosensitive layer comprises a matrix comprising an amine compound represented by the formula (I), a carrier transport material and a binder resin and a carrier generation material dispersed in the matrix.

12. In an electrophotographic method comprising repeated copying operations which include the steps of charging by a corona charging device, exposing, developing, transferring and cleaning, and which use repeatedly an electrophotographic photoreceptor having an electrically conductive substrate and a photosensitive layer formed thereon: the improvement comprising:

providing a photosensitive layer which contains a carrier generation material, a carrier transport material and an amine compound represented by the following formula (I):

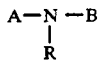

(I)

wherein A represents one selected from the group consisting of (i) $-CH_2X$, (ii) $-CH_2CH_2X$, wherein X represents an aromatic carbocyclic ring residue, an aromatic heterocyclic ring residue, a cycloalkyl group or a heterocycloalkyl group which may have a substituent, (iii) a cycloalkyl group or a heterocycloalkyl group which may have a substituent, and (iv) an aromatic carbocyclic ring residue or an aromatic heterocyclic ring residue which may have a substituent; B represents one selected from the group consisting of (i), (ii) and (iii) as defined in A; and R represents a hydrogen, alkyl group which may have a substituent or aralkyl group which may have a substituent.

* * * * *